United States Patent [19]

Orgeron

[11] Patent Number: 4,520,900

[45] Date of Patent: Jun. 4, 1985

[54] FIRE ESCAPE APPARATUS FOR USE IN HIGH-RISE BUILDINGS AND THE LIKE

[76] Inventor: Orey C. Orgeron, 706 Souvenir Gate, Lafayette, La. 70506

[21] Appl. No.: 477,143

[22] Filed: Mar. 21, 1983

Related U.S. Application Data

[63] Continuation-in-part of Ser. No. 438,035, Nov. 1, 1982.

[51] Int. Cl.[3] ..... A62B 1/02

[52] U.S. Cl. ..... 182/238; 182/233; 182/36; 182/142

[58] Field of Search ..... 182/142, 36, 37, 3, 182/238, 233, 70, 73, 236; 188/290, 292; 254/257, 377; 242/99

[56] References Cited

U.S. PATENT DOCUMENTS

| | | | |
|---|---|---|---|
| 481,888 | 8/1892 | Bergeron | 182/36 |
| 1,030,468 | 6/1912 | Haney | 182/142 |
| 1,971,294 | 8/1934 | Bunkes | 182/37 |
| 2,396,127 | 3/1946 | Riblet | 182/37 |
| 2,448,855 | 9/1948 | Black | 254/377 |
| 2,873,055 | 2/1959 | Hill | 182/19 |
| 3,159,110 | 12/1964 | Wylie | 182/142 |
| 3,261,590 | 7/1966 | Bech | 182/238 |
| 3,519,248 | 7/1970 | Kushiro | 254/377 |
| 3,526,388 | 6/1970 | Geiger | 254/377 |
| 4,270,628 | 6/1981 | Anderson | 182/37 |

FOREIGN PATENT DOCUMENTS

| | | | |
|---|---|---|---|
| 1914952 | 10/1970 | Fed. Rep. of Germany | 182/3 |
| 2306110 | 8/1974 | Fed. Rep. of Germany | 182/238 |

*Primary Examiner*—Reinaldo P. Machado
*Assistant Examiner*—Alvin Chin-Shue
*Attorney, Agent, or Firm*—Keaty & Keaty

[57] ABSTRACT

A personnel escape mechanism for emergency evacuation of a high-rise building. An escape support for personnel in the form of harnesses or a protective cage is suspended from a trolley, riding on a rail extending externally from the building. The escape support is suspended by cable from a constant speed rotationally braked cable payout mechanism mounted in the trolley. The support and trolley are impelled to the outside of the building through a frangible wall opening, and then lowered to a safe ground location by the braked cable pay-out mechanism. In a preferred embodiment of the invention, a steel cage is provided on wheels near window of safety glass. This cage is suspended from a cable wound on a cable drum, which is rotationally coupled to a hydraulic pump controlled by a restricted, closed loop flow path. The cable drum and pump are mounted in a trolley which rides on an I-beam projecting out of the building through the safety glass.

3 Claims, 6 Drawing Figures

FIRE ESCAPE APPARATUS FOR USE IN HIGH-RISE BUILDINGS AND THE LIKE

This application is a continuation in part of my copending application, Ser. No. 438,035, filed Nov. 1, 1982.

SUMMARY OF THE INVENTION

1. Field of the Invention

The present invention relates to a novel apparatus for facilitating the escape of people trapped within a burning high-rise building or the like, which does not depend upon external power or a temporary internal power source, both of which can be generally incapacitated by fire or emergency.

2. Background of the Invention

The present invention features a novel, unique apparatus which advances the state of the art in fire escape mechanisms. The prior art has severe problems in dealing with three major characteristics of any emergency escape situations from the high-rise building.

The first is that in an emergency event requiring evacuation, whether fire, earthquake, or sudden structural failure, usually results in interruption to most normal utilities, including electricity and lights.

The second major characteristic of any emergency situation is that the people who must be evacuated cannot be assumed to be in any particular physical condition or have any specified qualifications. Any practical escape apparatus must allow for people of limited strength, the handicapped, or relatively immobile; specific problems are persons in wheelchairs, the blind, or persons who have limited walking or running abilities.

Additionally, an evacuation emergency will induce panic; this results in the average evacuee being a person who is incapable of any complicated task, especially those tasks which involve controlling or operating a complex escape apparatus.

Elevators have been excluded as an escape apparatus both because of their known propensity to be damaged by the loss of the utilities and because their control will fail catastrophically during a fire. They are so dangerous that they are posted with signs according to standard safety regulations prohibiting their use.

Evacuations normally involve one of three techniques. The first and oldest technique is individual manual descent from the building by use of various forms of escape ladders or stairs. It should be obvious that in a high-rise building, defined as one having more than approximately eight to ten stories, a significant number of the people present will lack the strength to descend such a ladder, and panic will result in piling up of people, falls and serious injuries on so long a descent. Fire escape stairs, integrally built into a high-rise building, are additionally notorious as traps. Public advice varies as to whether it is better to ascend or descend. Persons on floors above the fire must trust to what is in shape, a chimney having the ever present possibility that the fire will at any moment penetrate the stairwell, with fatal consequences. In any case, persons who are handicapped simply cannot use such an escape means.

The second technique is removal by external escape devices. Ground based devices are all functionally "cherry-picker" like assemblies which can be raised from the ground, but which are ultimately limited to about the first four to five floors of any practical building. This renders them useless in the case of the high-rise escape situation. Helicopter escape, while honored in television and in literature, is impractical except for removing people from the flat roof of a building. The turbulence encountered in a fire situation renders operation of a helicopter in close proximity of a burning building extremely risky and has been known to limit successful escapes using such means. Further, the requirement that the persons must be removed from a flat ledge or surface reintroduces the escape problem by requiring the persons to go up instead of down.

The third technique involves a single person braked descent device. This is the closest prior art. As shown by Wilkins, U.S. Pat. No. 3,844,377 or Hill, U.S. Pat. No. 2,873,055, this art comprises an individual escape harness, often of some complexity, suspended from a cable which is paid out from a braked mechanism.

Hill shows a friction brake. Such a mechanism is affected by the fact that, as standing friction exceeds sliding friction, it will tend to lock up. Thus there must be a control means to release the brake to start descent; thereafter, controlled descent depends both on the continued maintenance of a minimum sliding friction and the lack of failure in the controller. Since, by design, the controller must be capable of releasing braking force, there is always the chance that the apparatus will fail, releasing the brake and dropping the evacuee to his doom.

Wilkins shows a powered descent device, which requires a driving means and a power source; his apparatus employs an electric motor and battery. Such devices require constant maintenance; must be isolated from building utility services due to the high probability of failure during an emergency; and are prone to failure, trapping victims and preventing escape.

The closest prior art, Belew, U.S. Pat. No. 4,018,423, avoids the friction braking problem by using a vane rotating in a closed fluid cylinder. While his disclosure avoids the run-away problem of friction brakes, it is essentially a torque convertor, as shown by his disclosure that his device develops torque as a function of rotational velocity. This results in Belew disclosing specifically a one-man descent device; increasing the descent load increases the velocity of descent, and thus his apparatus, by design, is restricted to a single optimum weight load.

It is an object of the current invention to overcome these constraints of the prior art and provide a more realistic escape apparatus.

First, as the occupancy of a high rise building is variable, unpredictable, and often high, it is an object of this invention to provide an escape apparatus which will provide a uniformly controlled emergency descent under widely varying conditions of load.

It is a second object of this invention to provide an apparatus which can be used safely by people during a panic stricken situation, without requiring physical skill or strength on the part of the user and without requiring the mastery of a complex operational process.

It is another object to provide an escape apparatus that will remain functional during prolonged storage with limited maintenance, as is required for any apparatus which will only be used once, and then only in an extreme emergency. This invention will, in fact, continue to function reliably in the event of no maintenance. It is thus the particular utility of this device in that it does not require any surviving characteristics or the presence of any utility services from the building; it does not require particular skill, knowledge, or training on the part of the users, and it will continue to function reliably even after an extended period in storage or out of maintenance.

This invention, as described further herein, basically includes a module or sub-assembly comprising a means of supporting and holding the people escaping from the building, which means is in turn suspended from a cable which is paid out from a cable takeup and unreeling device, a braking means controlling the speed with which this cable unreeling device pays out the cable, and a means for moving the entire module or sub-assembly from a place of ingress within the building to outside the building where the cable may be paid out and the people are lowered safely to the ground.

In a particular embodiment of this device, the personnel support means comprises either individual harnesses, as are currently designed for use in helicopter recovery situations of incapacitated persons, or a strong cage or enclosure, impervious to fire and smoke, easily entered by a number of people. In either case the support means is located, as are current exits, in prominently marked and placarded locations readily accesible to each floor. The support means, the cable, and the cable pay-out device altogether comprise a coupled sub-assembly which is suspended from a gravity operated mechanism, such as a trolley, that when released, crashes through the walls of the building; this requires a frangible wall section, such as the now common safety glass plate. The apparatus then lowers, via the support means, carrying the people down outside the building, clear of the fire.

The mechanism for removing the filled support means to the outside of the building can be as simple as a transverse I-beam and a trolley with rollers, which supports the cable pay-out mechanism in a protective enclosure. The entire support means, being suspended by the cable from the cable pay-out mechanism, can swing through the frangible opening to the outside upon acutation.

The cable pay-out mechanism is the method for controlling the descent of the support means to the ground and is therefore an integral portion of this invention. In a particular embodiment, this cable pay-out mechanism consists of a rotating take-up drum upon which the cable is spirally wound in multiple layers; the design of the mechanism being such that an adequate length of cable is wound on the drum to lower the support means to the ground from whichever floor the means is suspended.

The cable pay-out drum is rotatably connected to a unique hydraulic braking mechanism. The use of this hydraulic braking mechanism provides a controlled descent speed without requiring external power, a mechanically or friction brake, or external control, thus obviating the necessity for connection to a presumably disabled building utility system or the need for a skilled operator. Of greater significance, the mechanism has proven to provide essentially constant decent speed at all conditions of load.

This hydraulic braking mechanism consists of a pump of constant displacement design, whose fluid flow is limited by a flow restriction means which is a restriction orifice; this mechanism controls descent without requiring any control input. The need to eliminate control imput is imposed by the possibility of a panic stricken evacuation, where people will not adequately control descent of the apparatus. The orifice is connected into the pump within a closed loop hydraulic path.

In operation, rotation of the cable drum rotates the pump which in turn forces fluid through the orifice; any increased speed of cable drum rotation increases this flow; the increase flow results in turn in an increased back pressure to the pump conpensating for and correcting drum speed, creating a constant rotational velocity which is determined by the setting of orifice size.

In practical tests, a scaled down model has maintained constant rotational speed from the load to full load conditions, from zero to 900 pounds useful load.

This apparatus uses the least possible number of moving parts to control the descent and is therefore the most reliable, a critical consideration in any escape apparatus.

In a preferred embodiment, the rotational connection between the cable pay-out mechanism and the hydraulic pump is by means of a chain and sprocket mechanism. This permits the selection of a chain and sprocket ratio so as to enhance control of the speed by using a relatively slow moving pay-out to drive the hydraulic pump at a faster rate of speed to achieve the rate control by the flow orifice chosen. The chain and sprocket mechanism can also be designed to be stronger and more reliable under conditions of limited maintenance than an equalivent gear box mechanism, its condition being easily confirmed by visual inspection; it is thus a preferred method of achieving a rotational connection between the cable pay-out mechanism and the braking means.

In an alternate implementation, the hydraulic brake includes a hydraulic accumulator, which may be air loaded. This provides compensation for thermal expansion of the fluid in the closed loop hydraulic system.

In an alternate implementation, where it is desired to have the ability to pre-set desired rate of descent, it is possible to install a pre-settable orifice, such as a needle controlled valve, in place of the fixed orifice normally used. By choosing a suitable maximum and minimum orifice size, it is possible to assure that a safe lowering will take place in a condition of missetting, yet still give a reasonable ability to pre-set a desired descent velocity.

In summary then, this invention comprises a self-contained escape apparatus allowing people to escape from a building of whatever height with safety; this escape apparatus does not require the support of building utilities and does not assume any particular capability on the part of the building requiring evacuation; and it is completely self-contained and therefore of extreme value, providing an escape capability not available from any other currently availble escape means.

DETAILED DESCRIPTION OF THE PREFERRED EMBODIMENT

Figure 1:
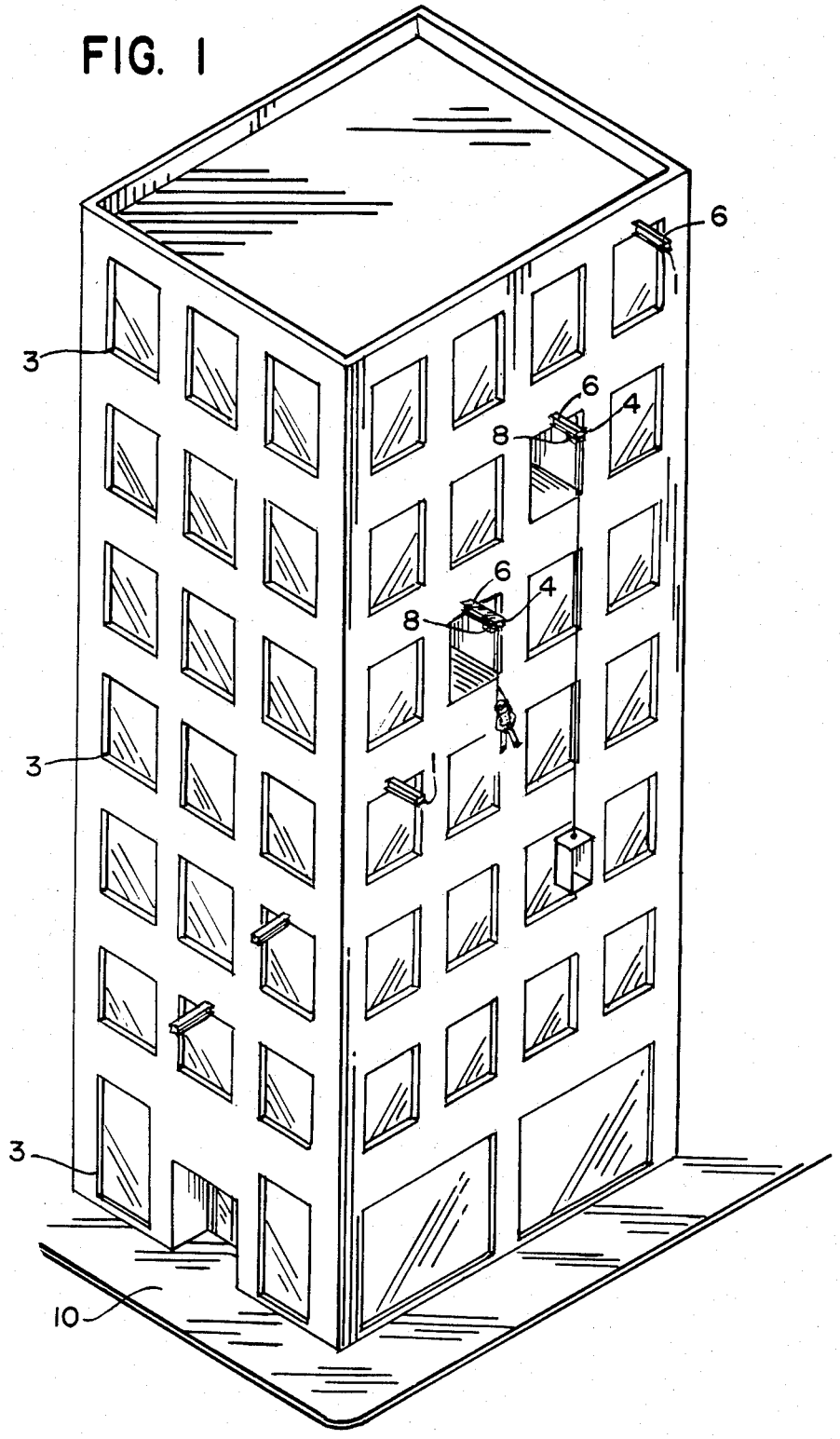
FIG. 1 is a perspective view of an embodiment of the present invention shown installed in a high-rise building.
Figure 2:
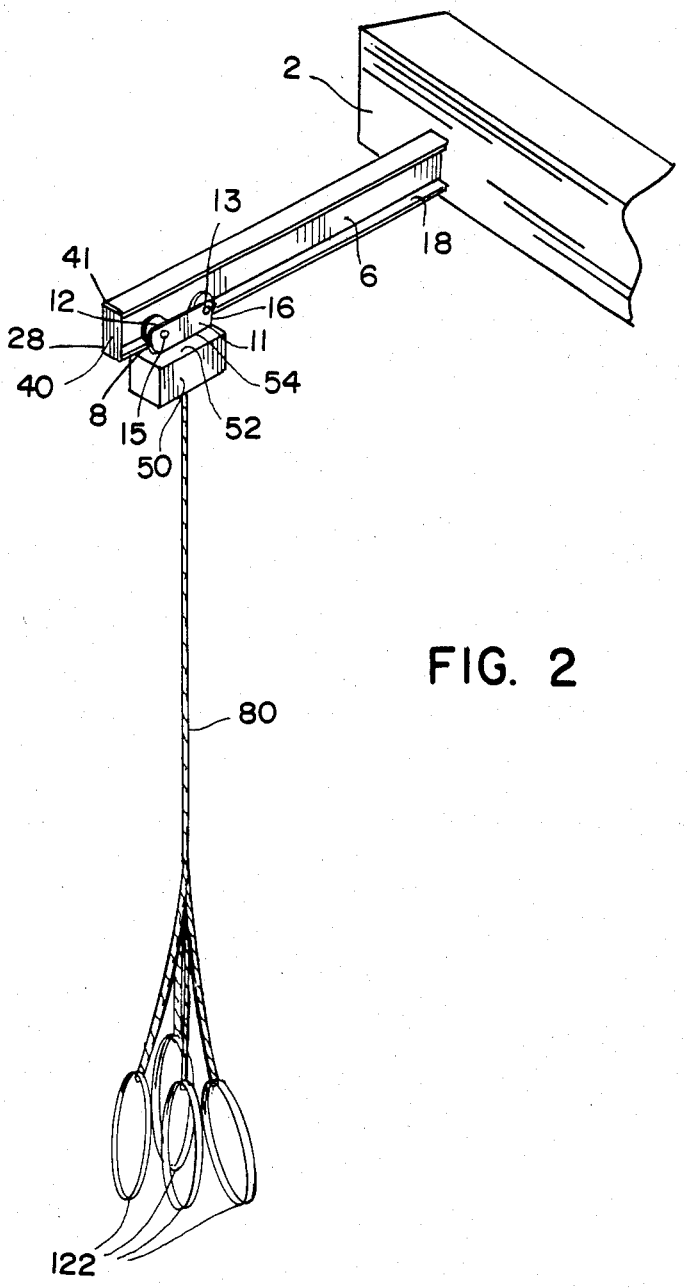
FIG. 2 is a side, cross-sectional view of one module of the present invention, in isolation.

Referring now to FIG. 1, there can be seen the apparatus of the present invention, designated generally by the numeral 1, installed within a high-rise building 2. The apparatus 1 of the present invention comprises at least one installation, indicated generally by the numeral 4, for each floor 3, preferably, of the building 2. Each installation 4 comprises, in the preferred embodiment, the followng elements:

1. A transverse member which, in the preferred embodiment, is a transverse I-beam lateral structural support member 6 of the building 2, wherein each member 6 extends from within the building 2 to the outside thereof, over the ground 10, whereby each member 6 is diagonally displaced from the next member of the next floor 3 below, for reasons which will hereinafter become apparent;

2. Referring now to FIG. 2, a trolley rail mechanism, indicated generally by the numeral 8, adapted for back and forth movement along member 6, wherein said trolley rail mechanism 8 is of standard design.

Figure 3:
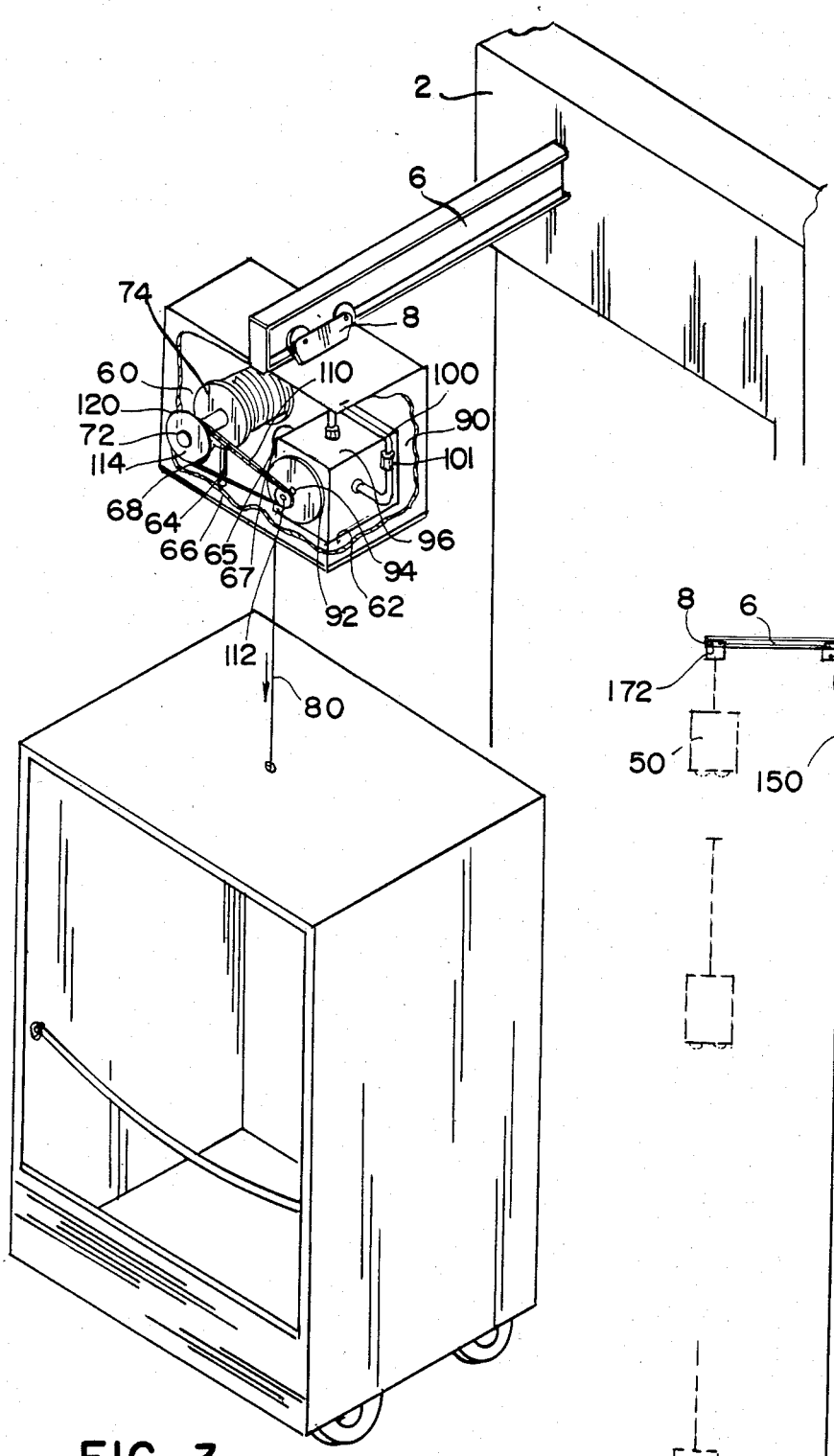
FIG. 3 is a side, cross-sectional elevational view of the preferred embodiment of the present invention.
Figure 4:
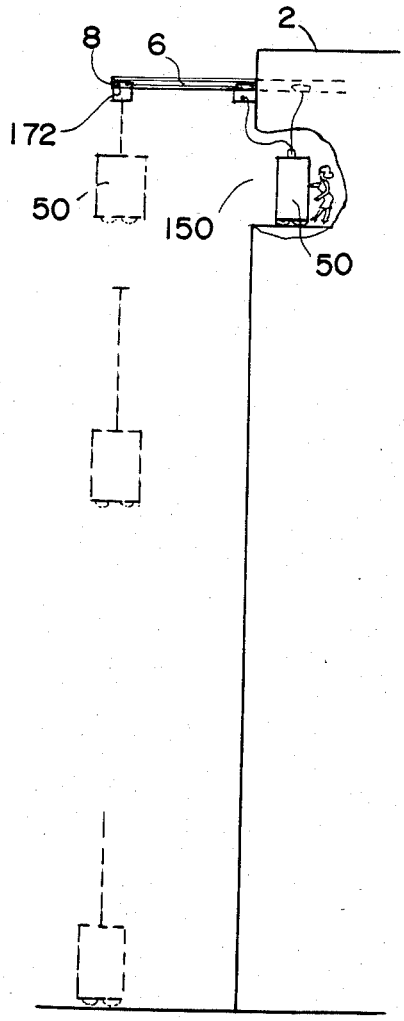
FIG. 4 is a side, partially cutaway view, of the manner of operation of the preferred embodiment of the present invention.

3. A generally rectangular plate 40, fixably attached, for example, welded, to the outer end 41 of member 6, thereby defining the outermost movement of trolley rail mechanism 8 therealong;

4. A protective housing 50, constructed of high-tensile strength steel, for example, 10,000 lb. tensile strength steel, the top surface 52 thereof being fixably attached, for example, welded, at the center of gravity of housing 50, to the bottom surface 54 of said third plate, thereby securably mounting housing 50 to trolley rail mechanism 8 for movement along member 6 therewith;

5. Transportation means, indicated generally by the numeral 60 in FIG. 3, mounted to the interior bottom surface of housing 50, wherein said transportation means 60 comprises:

a. a pair of diametrically opposed spaced-apart, apart, pedestal-type mounting brackets, 64, 65 securably mounted to the interior bottom surface of housing 50, at the center of gravity thereof, by means of, for example, bolts (not shown);

b. a pair of sealed bearings (not shown) securably mounted within apertures provided through backets 64, 65, respectively, diametrically opposite each other;

c. a preferably high-tensile strength steel shaft 72, rotatably journalled within said bearings;

d. a cable-carrying reel 74, preferably made of high-tensile strength and heat-resistant steel, or any other suitable structurally strong, durable, and heat-resistant material, circumferentially mounted to shaft 72 upon which cable 80 is wound spirally outward in periodically overlapping layers, cable 80 being at least as long as the height of the building 2;

6. Hydraulic braking means, indicated generally by the numeral 90 in FIG. 3, mounted to the interior bottom surface of housing 50 functionally adjacent to said transportation means, wherein said hydraulic braking means 90 comprises:

a. a constant displacement pump 92, for example the Hall 250 Series pump/motor, of sizes hereinafter described, having a shaft 94 partially journalled therewithin and partially extending outwardly therefrom, wherein the housing 96 of pump 92 is provided with a pair of opposed fluid apertures 98, 99 therethrough; pump 92 is mounted to the interior bottom surface of housing 50, by means of bolts (not shown), for example;

b. a closed hydraulic conduit 100 preferably made of high-tensile strength, heat-resistant metal, for example, aircraft aluminum hydraulic tubing, extending in a loop around housing 96 and fluidly connecting said apertures 98, 99, for continuously circulating hydraulic fluid (not shown) through conduit loop 100 and into housing 96 and back through conduit loop 100, which has a constriction 101, of a predeterminable diameter, for reasons which will hereinafter become apparent;

c. a hydraulic accumulator or hydraulic pressure regulating means 162, as discussed hereinafter, insertably and fluidly connected within the conduit loop 100;

7. Overdrive means, indicated generally by the numeral 110 in FIG. 3, connected between said transportation means 60 and said hydraulic braking means 90, wherein said overdrive means 110 comprises:

a. a first sprocket 112 mounted to the outwardly extending portion of shaft 94 of said hydraulic braking means 90;

b. A second sprocket 114, having a larger diameter than first sprocket 112, for example 4:1, mounted to the end of shaft 72 of said transportation means 60 nearer to shaft 94 of said hydraulic braking means 90;

c. a preferably high-tensile strength steel roller chain 120 mounted to first sprocket 112 and second sprocket 114, thereby functionally connecting first sprocket 112 to second sprocket 114. It is important to note that transportation means 60 and hydraulic braking means 90 are mounted to the interior bottom surface of housing 50 at the center of gravity of housing 50, for reasons which hereinafter become apparent;

8. A cage 172, as can be seen in FIG. 3 fixably attached to the end of cable 80 of cable-carrying reel 74, wherein cage 172 is preferably constructed of high-tensile strength and heat-resistant steel.

9. In an alternative embodiment a plurality of padded, sling harnesses 122, as can be seen in FIG. 2, similar to those used by helicopters to lift or lower people in rescue operations, fixably attached, for example, spliced, to the end of cable 80 carried by cable-carrying reel 74 of transportation means 60.

In operation, the apparatus of the present invention works in the following simple manner:

1. In the event a fire occurs within building 2, the fleeing evacuees would find housing 50 which would be positioned on each floor 3 of the building 2 adjacent to safety glass-type window 150, and having entered the cage 172, would acivate release means (not shown) which would crash cage 172 through the window 150, thereby shattering it into myriad non-harmful fragments, whereby cage 172 would subsequently descend as herein after described.

2. For the alternative embodiment, each evacuee having found housing 50 harnesses himself, with the aid of other evacuees, if necessary, within sling harnesses 122, preferably one evacuee per harness 122; each evacuee, after all evacuees have securably harnessed themselves within sling harnesses 122, crashes housing 50 through safety glass-type window 150, whereby safety glass-type window 150 shatters into myriad fragments, thereby preventing injury to said evacuees as they flee the burning high-rise building 2;

3. The weight of the evacuees automatically causes cable 80 carried by cable-carrying reel 74 of transportation means 60 to be unreeled from reel 74 downwardly toward the ground 10 adjacent to building 2, thereby causing said evacuees to correspondingly descend, since said cage 172 or said sling harnesses 122 are attached to the end of cable 80;

4. Shaft 72 of transportation means 60 is automatically rotated by the downward movement of cable 80 from reel 74, thereby causing said sprocket 114 of overdrive means 110 to simultaneously rotate therewith, thereby causing chain 120 to simultaneously cause first sprocket 112 attached to shaft 94 of hydraulic braking means 90 to simultaneously rotate therewith, but at a much faster rate than second sprocket 114 (i.e. more rpm's), thereby simultaneously imparting rotation of shaft 94 of hyraulic means 90, thereby causing said hydraulic fluid (not shown) to be continuously pumped/circulated through closed hydraulic conduit 100, whereby constriction 101 in hyraulic conduit 100 causes gear-type pump 92 to progressively increase the hydraulic pressure in conduit 100 as the victims descend, thereby simultaneously causing a progressive commensurate reduction in the rotation speed of first sprocket 112, thereby causing an even greater reduction in the rotation speed of second sprocket 114, thereby ultimately causing a commensurate reduction in the speed of rotation of shaft 72 of transportation means 60, whereby all of the above and foregoing thereby provides a constant velocity hydraulic braking action, in order to slow and regulate the descent of the fleeing evacuees on their flight from their location within the burning building 2 to the ground 10 to prevent injury to such persons upon impact with the ground 10 below. The relative diameters of said first sprocket 112 and second sprocket 114, the degree of the constriction 101 of closed hydraulic conduit 100 and the type of hydraulic fluid employed determine the rotational velocity of the rotating cable-carrying reel 74. The spirally wound cable 80 is paid out as the reel 74 rotates at essentially constant angular or rotational velocity; the progressively smaller turns on the inner layers of cable 80 on reel 74 results in a decreasing length of cable 80 being paid out as reel 74 rotates, thus effectively slowing the descent rate of the cage 172 or slings 122 as they approach the ground.

Figure 5:
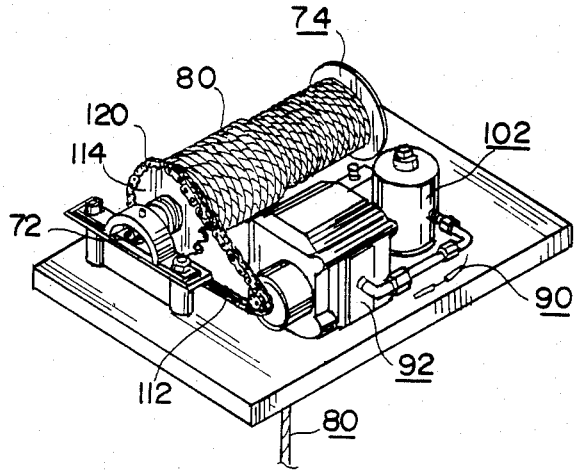
FIG. 5 is a prespective view of the preferred embodiment of the cable payout drum and hydraulic braking mechanism.
Figure 6:
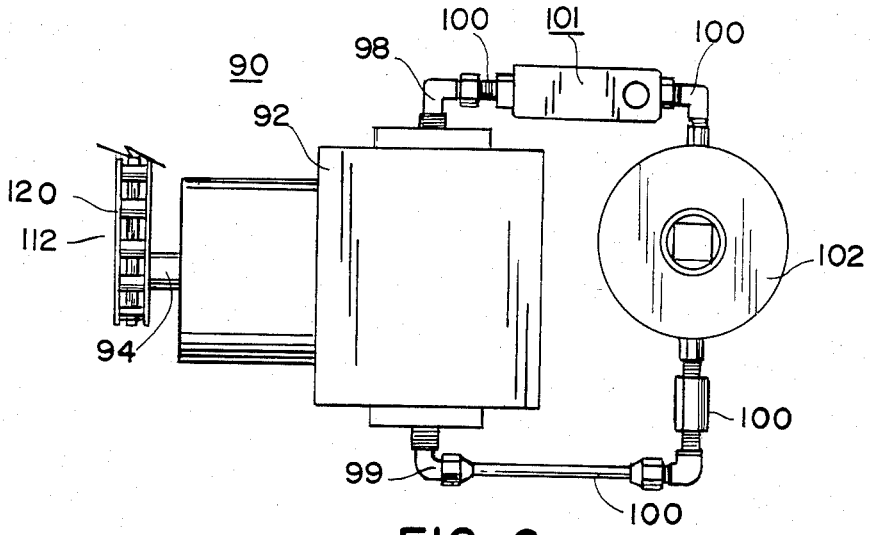
FIG. 6 is a top view of the preferred embodiment hydraulic braking mechanism showing the arrangement of the individual components thereof.

Referring now to FIG. 5, the hydraulic means, shown as item 90, incorporated by reference, is shown in more detail to comprise a pump 92, which can be any of a number of displacement hydraulic pumps, and in the preferred embodiment is a commercial model Hall 250 hydraulic pump available in varying gear widths. One experimental version has a two inch gear width pump producing eleven gallons per minute output at an r.p.m. of 550 r.p.m., which at a 4.0 to one gear ratio used in the preferred embodiment on the sprocket and chain gearing is a 150 r.p.m. drum pay-out rate for the cable drum producing a safe descent speed of 185 feet per minute.

A discharge port output 98 found on the pump 92 is connected by means of aircraft specification high pressure hydraulic tubing 100 capable of withstanding 10,000 p.s.i. overloads to the restrictor orifice number 101, which in the preferred implementation, is a needle controlled orifice adjusted to pass the sufficient gallons per minute necessary to assure the desired descent rate on the chosen pump. This provides a compensated volume flow control system with a micro adjustment, instantly responsive to settings in an alternate configuration is a constant diameter fixed orifice.

This constriction 101 is then connected through an identical piece of high strength aircraft hydraulic tubing 100, as aforementioned, to an inlet port 99 of pump 92. In the preferred configuration, the hydraulic breaking means includes a hydraulic pressure regulating means 102. Said pressure regulating means 102 comprises an air loaded actuator or similar hydraulic pressure damping device; this hydraulic pressure regulating means 102 is connected by means of an additional length of hydraulic tubing 100 between the aforementioned constrictor means 101 and the piece of hydraulic tubing 100 connecting to the inlet 99 of pump 92. In total then, this hydraulic means 90 gives a smooth reliable onset of breaking, establishes a constant speed descent, and ensures a safe, reliable evacuation of the building.

It should be noted that both the preferred and the alternate preferred hydraulic breaking means may be connected either through the chain and sprocket as shown in the preferred embodiment to the drum pay-out mechanism, or may be directly coupled thereto by co-axial coupling, or may be coupled by any rotational motion transfer means to the cable pay-out drum. It should be further noted that said cable pay-out drum may be supported by any bearings capable of supporting the load of the evacuation enclosure number 172 and personnel through the axis of the cable pay-out drum through any side load bearings. A preferred embodiment involves ball bearings as mentioned in my co-pending application, but any side thrust bearing, such as roller bearings or in fact bushings of sufficient load bearing capability, are acceptable.

The preferred embodiment uses a separately connected hydraulic braking means through the sprocket and chain aforementioned as a mechanical arrangement to comply with the requirement that the cable pay-out be located at the center of gravity of the overall enclosure means. This requirement insures a direct, downward load is applied to trolley rail mechanism 8 so that it remains evenly engaged to I-Beam 6. Alternate mechanical arrangements are acceptable as long as they comply with this requirement.

It should also be obvious from the description of the invention that any frangible material may be used as the outer wall through which the escape apparatus is slung through during evacuation. Temperated safety glass, which is a common building material in high-rise buildings, is mentioned as a preferred means as it can break into small and non-damaging pieces as the housing 50 is slung through it. Any frangible material with similar breaking characteristics is equally acceptable as an outer wall material.

In operation then, the hydraulic braking apparatus, as disclosed in this continuation in-part application, functions by restricting and controlling the pay-out of cable 80 lowering the evacuation housing 172, or slings 122, to the ground by restricting the flow of fluid from a constant displacement hydraulic pump 92 to a fixed gallon per minute rate which, as the pump 92 is directly mechanically connected to the pay-out drum, imposes a constant rotational speed upon said drum 74, and thus establishes the maximum speed with which the cable 80 pays out and the maximum speed with which the housing descends.

The hydraulic accumulator 102 pressure regulating means 102 relieves thermal expansion effects in the closed loop hydraulic system. The addition of the accumulator thus represents an improvement to the invention as disclosed in my co-pending application.

It should be understood that there are many variations of the basic inventive concept herein taught, and that the full scope of the present invention should be taken from the following claims, wherein:

I claim:

1. Fire escape apparatus for facilitating the escape of victims entrapped in a burning high-rise building having a plurality of floors comprising:

a. a support device for carrying a plurality of persons;

b. a cable affixed to said support device extending into and wound upon a cable take-up drum;

c. a constant velocity braking means rotatably connected to said drum for controlling the speed of unwinding thereof, said braking means comprising a constant displacement hydraulic pump and a closed hydraulic conduit, having a flow restriction means and a hydraulic pressure regulating means for continuously circulating hydraulic fluid within the hydraulic conduit and said pump, wherein said constant displacement hydraulic pump is rotatably connected to said cable carrying drum, an outlet of said pump being fluidly connected to a flow restricting means, an outlet of said flow restricting means being fluidly connected to a hydraulic pressure regulating means, an outlet of said pressure regulating means being connected to an inlet of said pump, the entire being filled with a hydraulic fluid;

d. a housing enclosing said cable drum and braking means rotatably connected thereto;

e. a means for removing the aforesaid personnel support device from within the buiding to outside of the building;

f. a mechanical overdrive means rotatably connected to said cable carrying drum and to said braking means, said overdrive means further comprising a first sprocket means fixedly mounted on a shaft of said cable-carrying drum, a second sproket means having a diameter at least twice as small as that of said first sprocket means, fixedly mounted on the shaft of said hydraulic pump of said braking means and an endless chain mounted on first and second sprocket means to operatively connect said drum and said braking means;

g. said mechanical overdrive means and said constant velocity braking means in combination with said cable-carrying drum producing a decreasing descent velocity.

2. The fire escape apparatus as described in claim 1, wherein said pressure regulating means further comprises an air loaded hydraulic accumulator.

3. The fire escape apparatus as described in claim 1, wherein said flow restricting means comprises a variable aperture orifice.

* * * * *